US005116052A

United States Patent [19]

Pop

[11] Patent Number: 5,116,052

[45] Date of Patent: May 26, 1992

[54] LOGIC PUZZLE

[76] Inventor: Dumitru A. Pop, 22718 2nd Dr., Bothell, Wash. 98021

[21] Appl. No.: 697,567

[22] Filed: May 9, 1991

[51] Int. Cl.[5] ..... A63F 9/08

[52] U.S. Cl. ..... 273/153 R; 273/153 S

[58] Field of Search ..... 273/153 R, 153 S, 155, 273/157 R, 160, 109, 113; 434/259, 403, 406; 446/102, 124, 125, 127

[56] References Cited

U.S. PATENT DOCUMENTS

| | | | |
|---|---|---|---|
| 479,475 | 7/1892 | Stutz | 273/109 |
| 3,235,263 | 2/1966 | Smith | 273/156 |
| 4,149,717 | 4/1979 | Seijiro | 273/157 R X |
| 4,378,116 | 3/1983 | Rubik | 273/153 S |
| 4,484,744 | 11/1984 | Gmünder | 273/153 S |
| 4,540,177 | 9/1985 | Horvath | 273/153 S |
| 4,553,754 | 11/1985 | Wiggs et al. | 273/153 S |
| 4,698,023 | 10/1987 | Marino | 434/403 X |
| 4,706,956 | 11/1987 | Abu-Shumays et al. | 273/153 S |
| 4,715,605 | 12/1987 | Fritzman | 273/156 |
| 4,836,549 | 6/1989 | Flake | 273/153 S |

FOREIGN PATENT DOCUMENTS

| | | | |
|---|---|---|---|
| 1199351 | 1/1986 | Canada | 273/153 S |
| 2578169 | 9/1986 | France | 273/153 S |
| 1442234 | 12/1988 | U.S.S.R. | 273/157 R |
| 1472081 | 4/1989 | U.S.S.R. | 273/153 S |

*Primary Examiner*—William H. Grieb
*Assistant Examiner*—Sebastiano Passaniti
*Attorney, Agent, or Firm*—Henderson & Sturm

[57] ABSTRACT

A spatial logical puzzle construction (10) including an upper (13) and lower (14) housing member operatively and rotatably connected together and provided with a plurality of cooperating recesses (16) that form apertures that contain groups of individual puzzle segments (20) that may be rotated within and transferred between the apertures.

5 Claims, 2 Drawing Sheets

LOGIC PUZZLE

TECHNICAL FIELD

The present invention relates to Logic Puzzles in general, and in particular to Logic Puzzles involving diverse manipulations of disparate elements of the puzzle to obtain the solution to the puzzle.

BACKGROUND ART

As can be seen by reference to the following U.S. Pat. Nos. 4,378,116; 4,540,177; 4,706,956; and 4,715,605; the prior art is replete with myriad and diverse spatial logical puzzles.

While all of the aforementioned prior art constructions are more than adequate for the basic purpose and function for which they have been specifically designed, these prior art constructions are uniformly deficient; in that, they employ external puzzle segments that have a uniform size and shape and, which are evenly distributed over the entire surface area of the puzzle. This particular type of construction produces a puzzle arrangement that in many instances simply is too complex for individuals having difficulty in understanding spatial logical principles to comprehend; thereby making the solution to the puzzle impossible to arrive at except by chance.

As a consequence of the foregoing situation, there has existed a longstanding need for a simplified type of spatial logical puzzle construction which will essentially teach a player the basic principles that govern spatial logic, so that they can go onto the more complex type of puzzles; and, the provision of such a construction is a stated objective of the present invention.

DISCLOSURE OF THE INVENTION

Briefly stated, the spatial logical puzzle construction that forms the basis of the present invention comprises a housing unit and a plurality of relatively moveable puzzle units that are operatively associated with one another and the housing units in a relatively simple and straightforward manner.

As will be explained in greater detail further on in the specification, the housing unit comprises an upper and a lower housing member which are relatively rotatable with respect to one another; wherein, each of the housing members are provided with a plurality of cooperating recesses which are alignable with one another.

In addition the plurality of cooperating alignable recesses are adapted to form spaced apertures in the housing unit; wherein, the spaced apertures are dimensioned to receive the plurality of puzzle units around the periphery of the housing unit.

Furthermore each of the puzzle units comprises a plurality of individual puzzle segments arrayed into a plurality of distinct groups; wherein, the segments of one group can be moved not only between the upper and lower housing members; but, can also be transferred from one group of segments to another group of segments.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
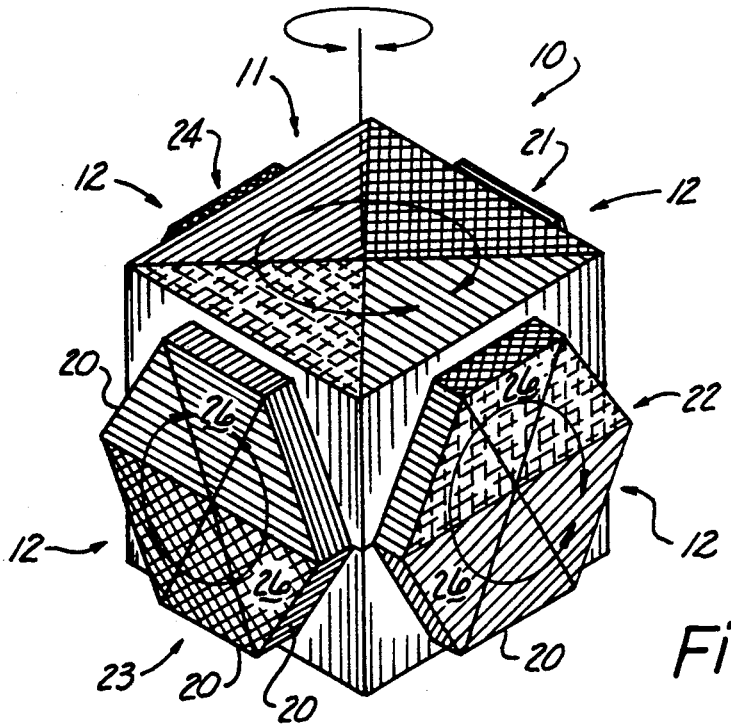
FIG. 1 is a perspective view of the spatial logical puzzle construction that forms the basis of the present invention.

As can be seen by reference to the drawings, and in particular to FIG. 1, the spatial logical puzzle construction that forms the basis of the present invention is designated generally by the reference numeral (10). The construction (10) comprises in general a housing unit (11) and a plurality of puzzle units (12). These units will now be described in seriatim fashion.

Figure 2:
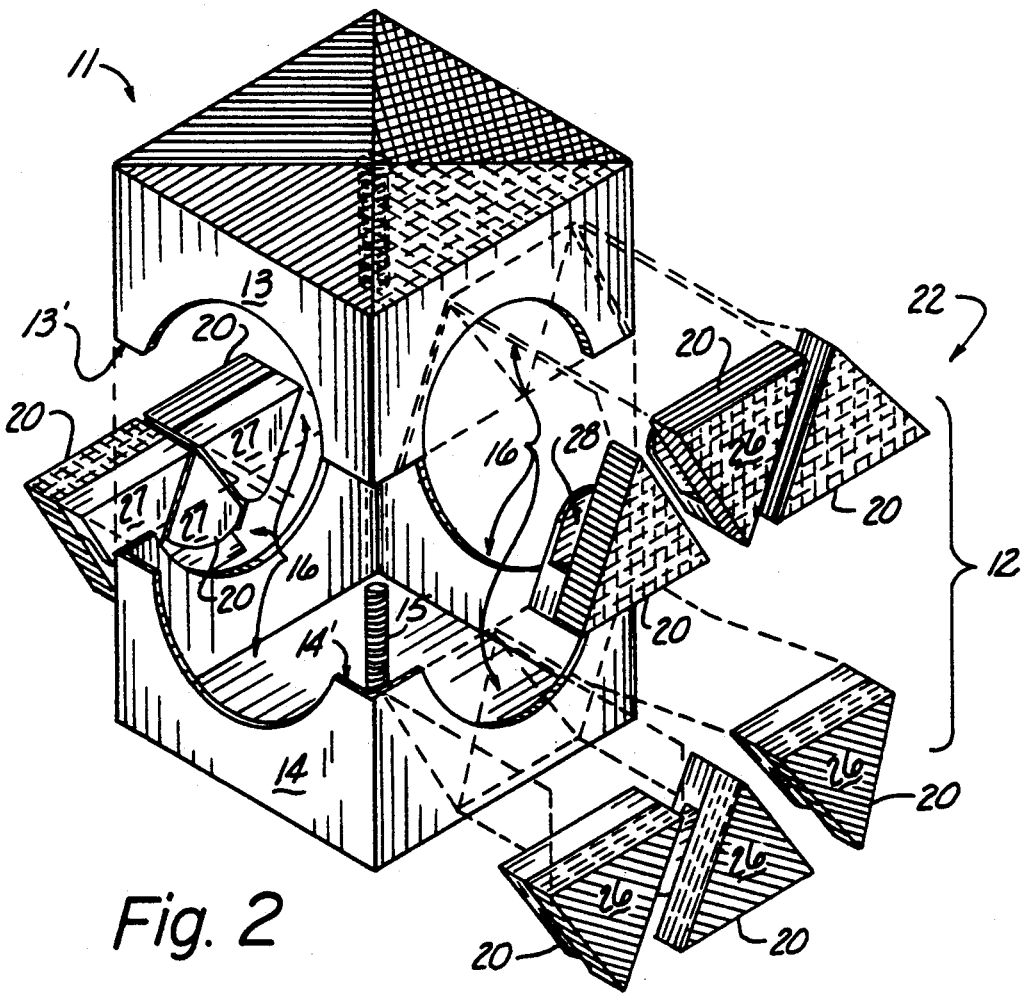
FIG. 2 is an exploded perspective view of the puzzle construction.
Figure 4:
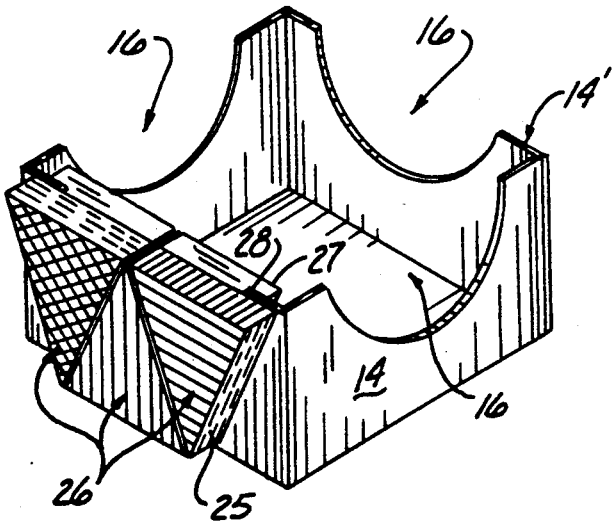
FIG. 4 is an isolated perspective view of the lower housing member and part of one of the puzzle units; and, FIG. 5 is an isolated rear perspective view of one of the puzzle segments.

As shown in FIGS. 2 and 4, the housing unit (11) comprises an upper (13) and a lower (14) housing member which are operatively connected together by a central securing member (15) which allows the housing members (13) and (14) to rotate relative to one another.

As can also be seen by reference to FIGS. 2 and 4, both the upper (13) and lower (14) housing members are each provided with a plurality of equally spaced generally semi-circular recesses (16) which are disposed on the abutting peripheries (13') (14') of the upper (13) and lower (14) housing members.

In addition it should be appreciated at this juncture that the opposed recesses (16) in the housing members (13) and (14) define generally circular apertures in one mode of disposition of the puzzle construction (10).

Prior to embarking on a description of the plurality of puzzle units (12) it should first be noted that while the housing unit (11) of the preferred embodiment is depicted in the drawings as having a generally rectangular configuration, this invention also contemplates the use of other conventional geometric shapes such as a sphere, oval or the like.

Figure 3:
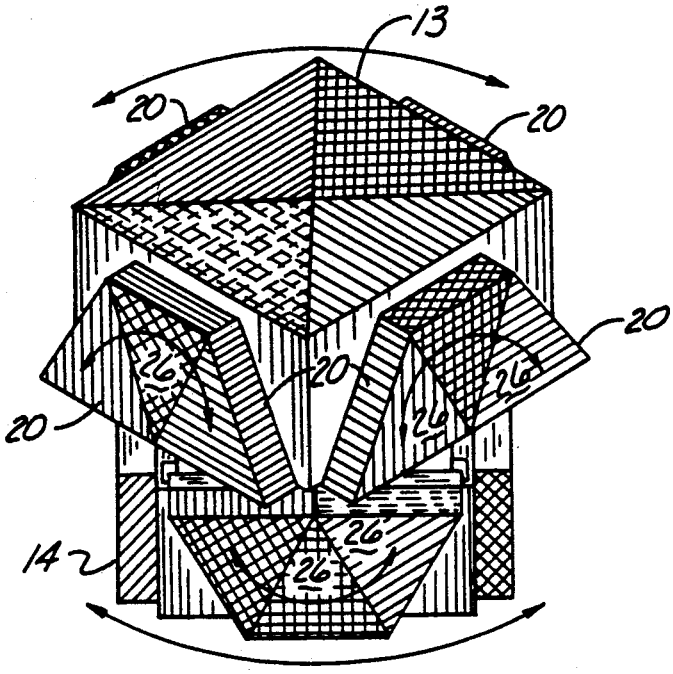
FIG. 3 is a perspective view of the construction showing the upper housing member being rotated relative to the lower housing member.

As can best be seen by reference to FIGS. 1 and 3 the plurality of puzzle units (12) each comprise a plurality of individual discrete puzzle segments (20) arrayed into a plurality of groups (21) (22) (23) (24) of a preselected number "n" of individual segments (20); wherein the plurality of groups (21) (22) (23) (24) of segments (20) is identical in number to the plurality of apertures formed by the opposed recesses in the housing members (13) and (14).

Figure 5:
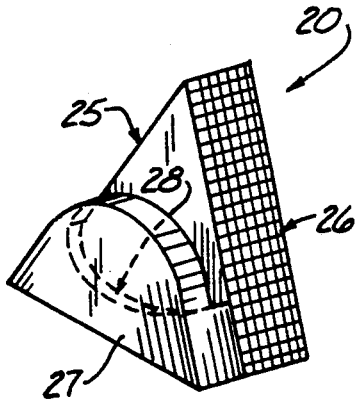

As can best be appreciated by reference to FIGS. 4 and 5 each of the puzzle segments (20) comprises a segment body (25) having an enlarged front face panel (26) a reduced dimension rear tab element (27) and an arcuate groove (28) formed intermediate the front face panel (26) and the rear tab element (27); wherein the arcuate groove (28) is dimensioned to receive the peripheral portions of the housing members (13) and (14) surrounding the semi-circular recesses (16); such that the segment bodies (25) are movably disposed within the individual recesses (16) and also transferable between recesses (16), as will be explained presently.

Turning now to FIGS. 1 and 3, it can be seen that in one mode of disposition of the construction all of the segments (20) of each group (21) (22) (23) (24) may be rotated in the apertures formed in the upper (13) and lower (14) housing members; however, due to the fact that the housing members (13) and (14) may be rotated relative to one another to bring different recesses (16) into alignment, each of the segments (20) may be transferred from any of the recesses (16) in either the upper (13) or the lower (14) housing members, by manipulation of the segments (20) and the housing members (13) and (14) relative to one another.

Furthermore as shown in FIGS. 1 through 3, the face panels (26) of the segments (20) as well as portions of the upper and lower housing members (13) and (14) may be provided with different indicia, such as colors, patterns, textures, etc. such that the objective of the puzzle would be to manipulate the segments (20) having similar indicia on their face panels (26) into the same groups (21) (22) (23) and (24) and then aligning those groups with the same indicia on the housing members (13) and (14).

It should further be noted that despite the fact that the segments (20) depicted in the drawings have a generally triangular configuration, this invention also contemplates other geometric shapes such as arcuate segments, or the like.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I CLAIM:

1. A spatial logical puzzle construction consisting of:

a housing unit including an upper and a lower housing member operatively and rotatably connected to one another; wherein, both the upper and lower housing members are provided with a plurality of semi-circular recesses which are alignable with one another to create a plurality of circular apertures around a periphery of the housing unit; and, a plurality of puzzle units; wherein, each puzzle unit comprises a plurality of individual discrete puzzle segments; wherein, each of said discrete puzzle segments comprises a segment body having a triangular front face panel, a rear tab element, and an intermediate generally arcuate groove formed between the triangular face panel and the rear tab element; wherein, the intermediate groove is dimensioned to receive a peripheral portion of each of the housing members surrounding the recesses; such that the puzzle segments are moveable within and transferrable between the recesses formed in the upper and lower housing members; and, wherein each of said plurality of puzzle units is disposed in one of said plurality of circular apertures in said housing unit.

2. The puzzle construction as in claim 1; wherein the puzzle segments are arranged into a plurality of groups of puzzle segments; wherein, each group of puzzle segments contains the same number "n" of individual segments; and, wherein each group of puzzle segments is disposed in a different aperture among said plurality of apertures in said housing unit.

3. The puzzle construction as in claim 2; wherein the face panels of each group of puzzle segments are provided with indicia.

4. The puzzle construction as in claim 3; wherein, the indicia of the individual segments of each group is the same; but, the indicia on the groups are different from one another.

5. The puzzle construction as in claim 4; wherein, the housing unit is provided with selected portions having different indicia; and, wherein the different indicia on the housing unit coincide with the indicia on the different groups.

* * * * *